US007588484B2

(12) United States Patent
Momosaki

(10) Patent No.: US 7,588,484 B2
(45) Date of Patent: Sep. 15, 2009

(54) MOUNTING SYSTEM FOR GRINDING WHEELS AND THE LIKE

(75) Inventor: Mitsukazu Momosaki, Fukuoka (JP)

(73) Assignee: NAO Enterprises, Inc., Oakland, NJ (US)

( * ) Notice: Subject to any disclaimer, the term of this patent is extended or adjusted under 35 U.S.C. 154(b) by 0 days.

(21) Appl. No.: 11/335,132

(22) Filed: Jan. 19, 2006

(65) Prior Publication Data

US 2007/0167119 A1 Jul. 19, 2007

(51) Int. Cl.
*B24B 23/00* (2006.01)

(52) U.S. Cl. ..... 451/359; 451/508; 451/509

(58) Field of Classification Search ..... 451/508, 451/509, 359

See application file for complete search history.

(56) References Cited

U.S. PATENT DOCUMENTS

| | | | | | |
|---|---|---|---|---|---|
| 2,654,193 | A | * | 10/1953 | Rich et al. | 451/508 |
| 2,671,994 | A | * | 3/1954 | Hickman | 451/508 |
| 2,839,879 | A | * | 6/1958 | Eisenbeis | 451/509 |
| 3,158,972 | A | * | 12/1964 | Mackay, Jr. et al. | 451/509 |
| 3,270,467 | A | * | 9/1966 | Block et al. | 451/509 |
| RE26,552 | E | * | 3/1969 | Block et al. | 451/509 |
| 3,491,494 | A | * | 1/1970 | Mackay, Jr. | 451/509 |
| 3,574,978 | A | * | 4/1971 | Block | 451/509 |
| 3,623,281 | A | * | 11/1971 | Moffat | 451/509 |
| 4,245,438 | A | * | 1/1981 | van Buren, Jr. | 451/509 |
| 4,839,998 | A | * | 6/1989 | Block | 451/509 |
| 5,619,770 | A | | 4/1997 | Bell | |
| 5,678,272 | A | * | 10/1997 | McCracken et al. | 15/97.1 |
| 6,067,705 | A | | 5/2000 | Boyde et al. | |
| 6,116,996 | A | * | 9/2000 | Yanase | 451/359 |
| 6,382,058 | B1 | | 5/2002 | Owoc | |
| 6,523,214 | B1 | * | 2/2003 | Kaiser | 15/230 |
| 6,786,811 | B2 | | 9/2004 | Krondorfer et al. | |
| 6,869,346 | B2 | | 3/2005 | Wendt et al. | |
| 6,887,142 | B2 | | 5/2005 | Rupprecht et al. | |

OTHER PUBLICATIONS

Klingspor, CMT Quick Change Flap Disc System, 4 pages, date unknown.

* cited by examiner

*Primary Examiner*—Maurina Rachuba
(74) *Attorney, Agent, or Firm*—Ladas & Parry LLP

(57) ABSTRACT

A mounting system for rotating tools such as grinding wheels in a hand-held power tool, includes a hub mountable to the tool drive shaft and a rotating tool element removably affixable to the hub. The tool has at least one flange that engages a corresponding circumferential groove in a hub wall. Both the hub and tool have complimentary lock elements to frictionally retain the tool in a releasably fixed orientation upon the hub. One of the lock elements is in the form of a depression, while a mating element located on the other ports is a complimentary projection.

6 Claims, 6 Drawing Sheets

MOUNTING SYSTEM FOR GRINDING WHEELS AND THE LIKE

The present invention relates to a mounting system for affixing rotating tools, such as grinding wheels, circular saw blades, and the like to a tool arbor such is found in hand-held power tools.

BACKGROUND OF THE INVENTION

Hand-held power tools, such as grinders, sanders, saws, and the like include a motor driven arbor shaft to which is mounted an appropriate tool head, such as a grinding wheel, sanding disk, or circular saw blade. The arbor is typically threaded, allowing a tool hub to be affixed thereon, such as by a mounting nut assembly. The hub may be an integral part of the rotary tool, but often a hub is provided as an intermediate coupling unit between the arbor and the tool element, which is removably mounted to the hub. This latter form of tool head construction is often preferred, as it allows the work-engaging tool element, such as a grinding wheel, to be removed from the hub when worn without disengaging the hub itself from the arbor shaft. Further, such a construction allows the replacement and interchange of the working tool elements without replacement of the hub. This is of significant value, since during the course of operation a variety of tool elements often are required. This provides for more economical tool element exchange and further lessens the down time of the tool for such exchange.

Various constructions have been proposed for mounting disk-shaped tools on a hub in a removable manner. U.S. Pat. No. 6,116,996 to Yanase, for example, utilizes a flange system in conjunction with a gravity-driven stopper to assist maintaining the tool disk in position on a hub-like member. U.S. Pat. No. 6,786,811 to Krondorfer, et al mounts a tool element through a system utilizing circumferential and axial locking elements. Often sanding disks and the like are removably mounted using hook-and-loop fastener systems. While such systems are satisfactory for low rpm operation, they may not provide sufficient holding power for high rpm applications.

Notwithstanding the efforts of others, it remains a goal in the tool art to provide a mounting system for rotary tools that allows a rotary tool to be easily and quickly mounted upon or removed from a hub, but securely retains the rotating tool upon the hub to prevent inadvertent disengagement therefrom over a wide range of operating speeds.

It is accordingly an object of the present invention to provide such a tool mount which is of economical construction, and allows a rotary tool to be quickly and efficiently mounted upon and removed from a tool hub typically mounted to a tool arbor.

It is a further purpose of the present invention to provide such a mounting system that further provides secure retention of the tool element in a fixed position on the hub to prevent inadvertent disengagement therebetween.

BRIEF DESCRIPTION OF THE INVENTION

In accordance with the foregoing and other objects and purposes, a rotary tool mounting system in accordance with the present invention comprises a hub mountable to the tool drive shaft and a tool element removably mountable on the hub. The tool element has an arcuate flange projecting into a central mounting aperture, while the hub has an axially-extending wall with a circumferential groove to retain the tool element flange. Each of the hub and tool element has at least one complementary lock element in the form of a projection or a mating depression. When the tool element is fully mounted on the hub the projections and depressions align, frictionally retaining the tool element in a fully mounted position on the hub.

In a first embodiment the hub may be provided with projections on a face, while the tool element has complementary depressions on an opposed face. In a second embodiment the tool element may have radially inwardly extending projections and the depressions are located on the hub wall.

BRIEF DESCRIPTION OF THE DRAWINGS

A fuller understanding of the present invention will be attained upon consideration of the following detailed explanation of preferred but nonetheless illustrative embodiments of the invention, when reviewed in conjunction with the annexed drawings, wherein.

DETAILED DESCRIPTION OF THE INVENTION

Figure 1:
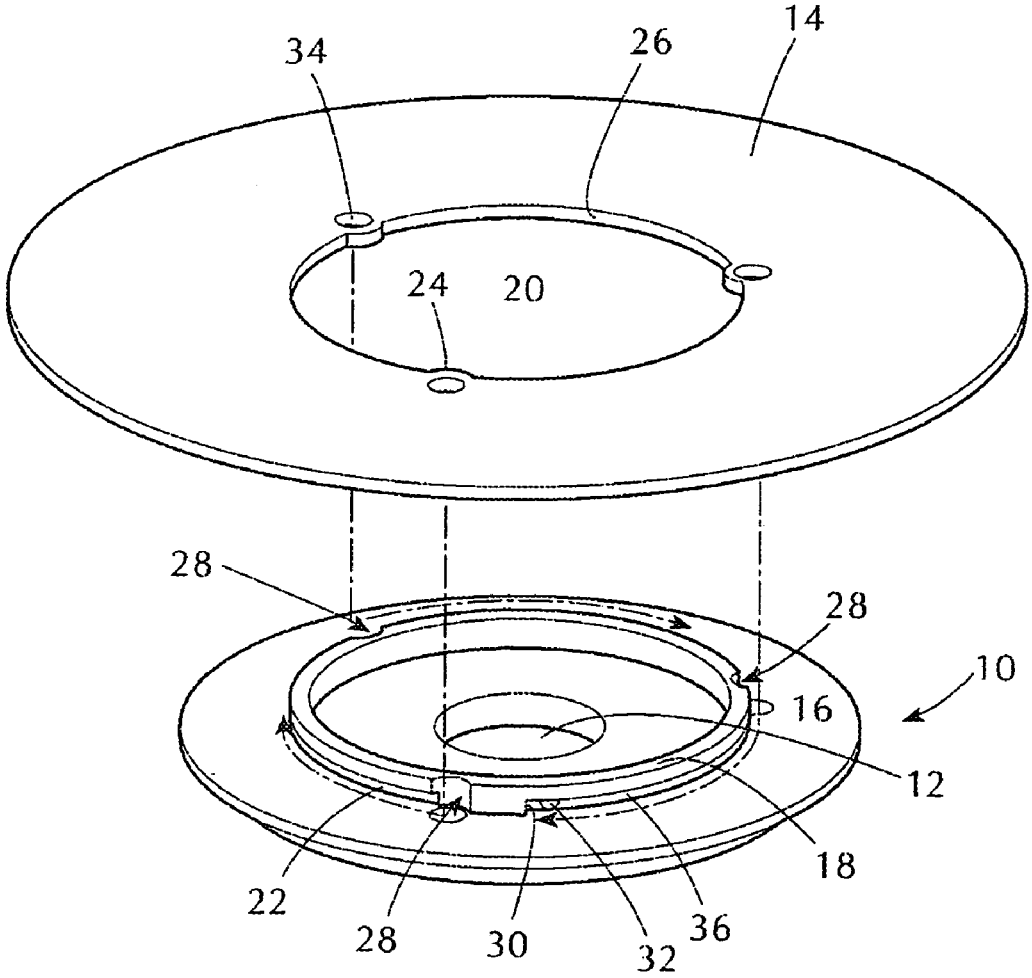
FIG. 1 is an exploded perspective view of a first embodiment of the mounting system of the present invention.

With initial reference to FIG. 1, the mounting system of the present invention comprises a generally circular hub 10, adapted to be mounted upon an arbor of a motorized tool, and particularly upon the arbor of a hand-held tool. The hub includes a central mounting bore 12 to accept the tool arbor or shaft, and may include recesses on its bottom face (not shown) to engage complementary lugs on an arbor flange. The hub is retained on the arbor shaft by means as known in the art, as by a flange and lock nuts. Circular tool element 14 is removably mounted to the hub. As recognized in the art, tool element 14 may be a retaining member to which a working element, such as a sandpaper disk or grinding member is affixed, or may itself comprise a cut-off wheel assembly or circular saw blade unit. The tool element is installed upon the hub by being moved axially with respect to the arbor into contact with hub face 16 and then rotated with respect to the hub into a retained and locked position. Removal of the tool element from the hub is easily performed by first counter-rotating the tool element to disengage the lock mechanism and clear the retention means, and then lifting the tool element axially off and away from the hub.

A first embodiment of the mounting system is depicted in FIGS. 1-6. Hub 10 has face 16 against which a bottom face of the tool element 14 abuts. Circumferential wall 18 extends upwardly from the hub face surface, axially with respect to the tool arbor on which the hub is mounted. The diameter of tool element mounting bore 20 is chosen to create a closely aligning fit with the wall. As may be seen in FIGS. 1 and 5, the wall 18 is undercut along its outer surface adjacent face 16 to provide one or more, and preferably three, circumferential recesses or grooves 22.

Figure 2:
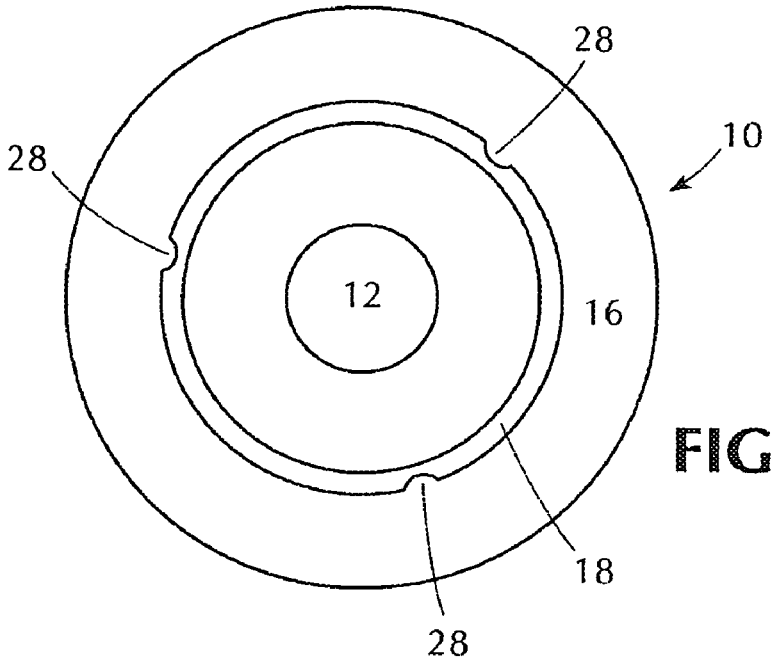
FIG. 2 is a plan view of the hub depicted in FIG. 1.

Tool element 14 includes spaced flanges or projections 24 extending inwardly along the sidewall 26 of its mounting bore 20. The projections are dimensioned to be received by the recesses 22, thereby retaining the tool element 14 upon the hub. As seen in FIG. 2, the hub wall 18 is provided with a corresponding number of cut-out portions 28, complimentary to the shape of the projections 24, to provide access to the recesses by the aligned projections. With the tool element mounted upon the hub the tool element can be rotated with respect to the hub, moving the projections out of alignment with the receiving cut-outs 28 to retain the tool element on the hub. As seen in FIG. 1, each of the grooves 22 terminates at an end wall 30 against which the projections abut to define an endpoint for mounting rotation of the tool element with respect to the hub.

To maintain the tool element in the fully mounted position, the hub and tool element are provided with complementary frictional lock elements. As may be best seen in FIGS. 1 and 6, the sidewalls 36 of hub grooves 22 are provided with detents 32, contoured to receive the projection elements 24 as the tool element is rotated into the fully mounted position. Engagement of the projections with these recesses provides a further frictional retaining force between the tool and hub. The recess sidewalls may be inclined away from the center of the hub at areas y-y as they approach the detents 32, forming a smooth approach surface to the detent while permitting a sufficiently deep detent to be formed to retain the projection. The end wall 30 of the groove may form the distal end of the detent.

Figure 3:
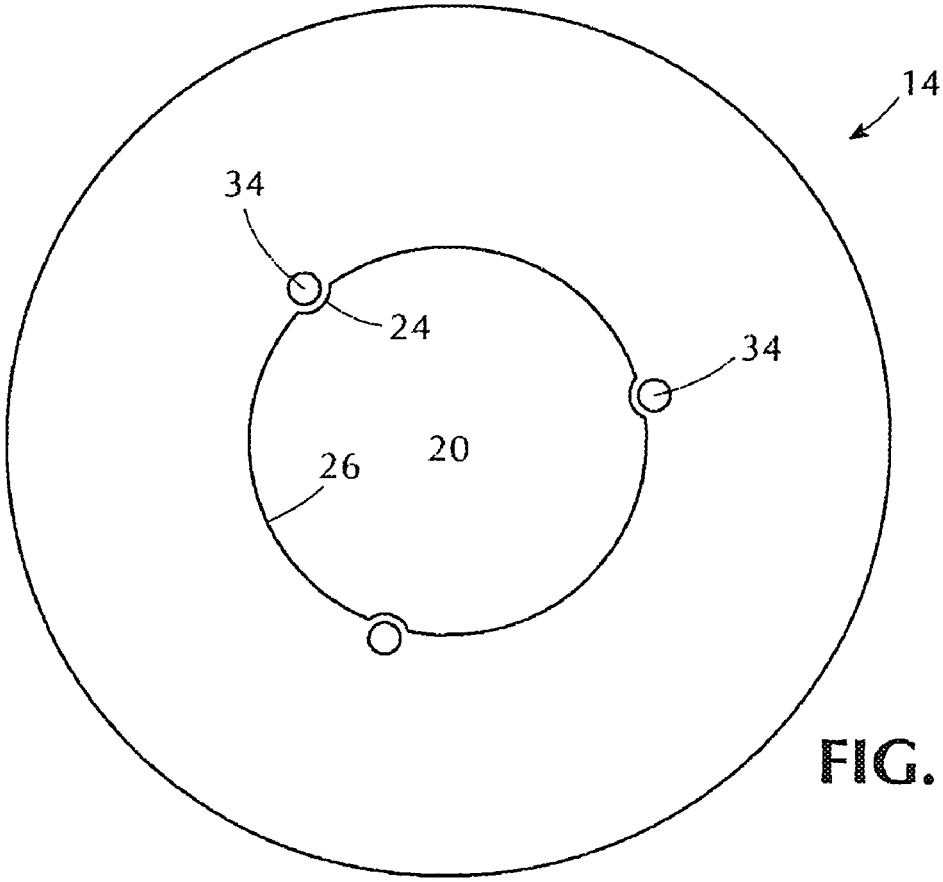
FIG. 3 is a plan view of the tool element of FIG. 1.
Figure 4:
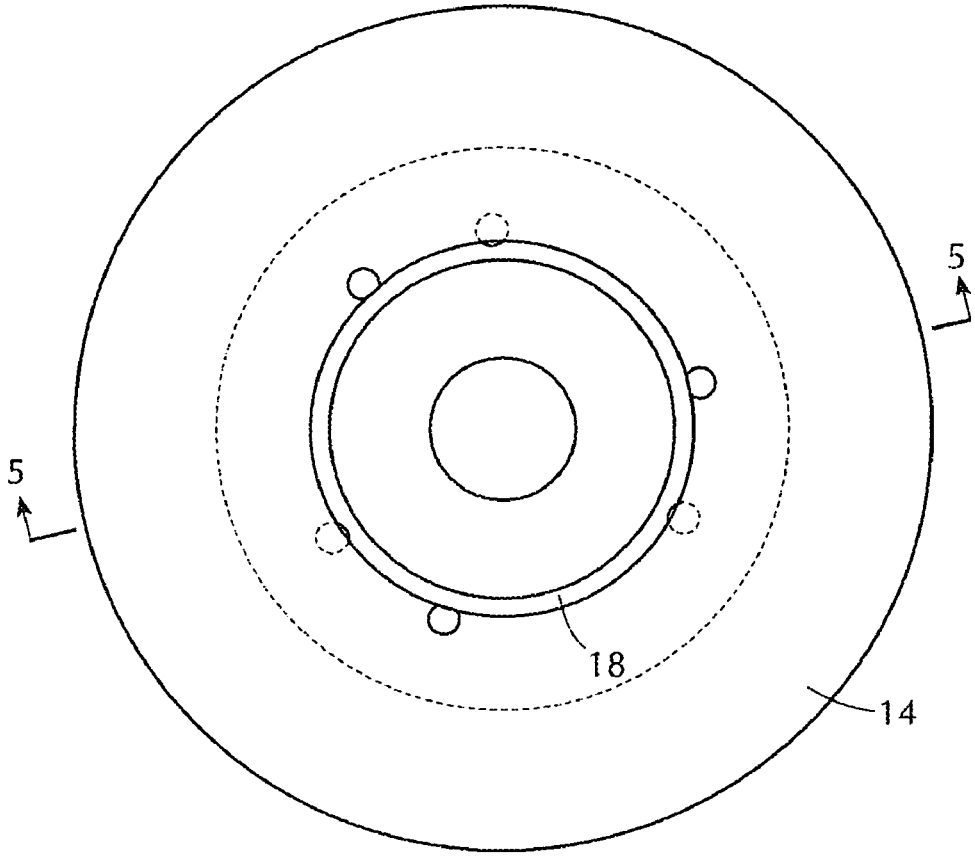
FIG. 4 is a plan view of the mounting system showing the tool element in a mounted and locked position on the hub.
Figure 5:
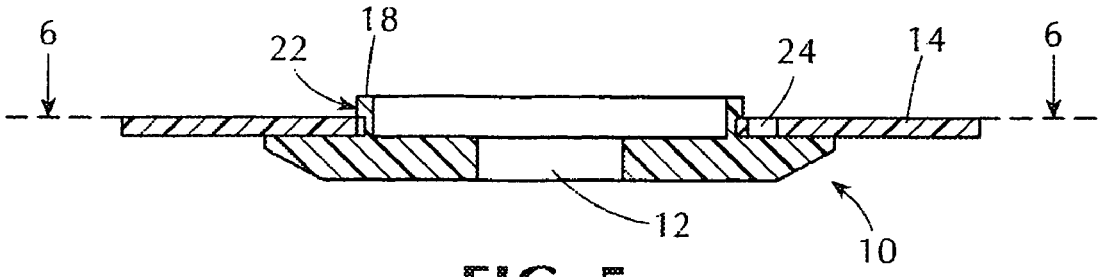
FIG. 5 is a section view taken along line 5-5 in FIG. 4.
Figure 6:
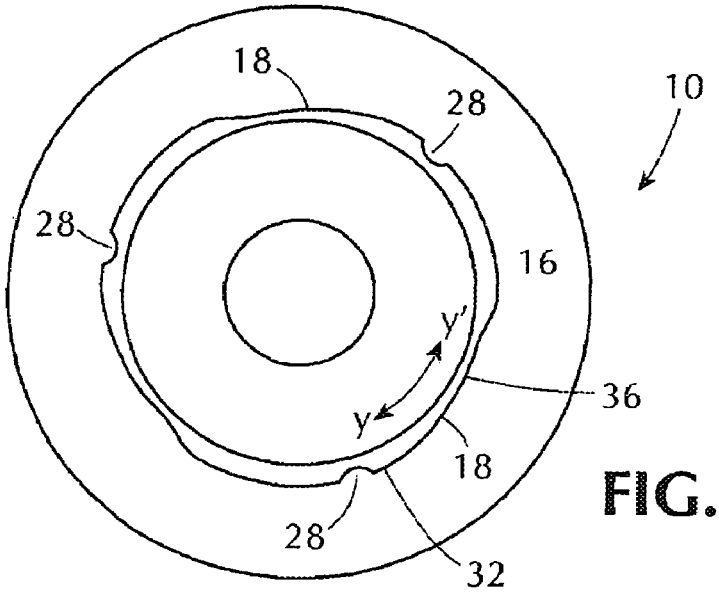
FIG. 6 is a section view of the hub taken along line 6-6 in FIG. 5.

As seen in FIGS. 1 and 3, each of projection elements 24 may be formed as a neck-like portion of the tool element material, typically a tough and resilient plastic or synthetic, about bores 34. Such a construction provides sufficient resiliency for the projection/flange elements to be slightly deformed or compressed as they engage against the inclined portions of the recess sidewall as the tool element is rotated on the hub, returning to an uncompressed state when they enter the detent depressions 32 to releasably lock the tool element in position.

FIGS. 7-11 depict an alternative embodiment of the invention. With initial reference to FIG. 8, hub 10 with mounting aperture 12 accepts tool element 14. Circumferential hub wall 18 has an outer surface 38 which is sized to mate with the inner surface 40 of tool element mounting bore 20. The surface 40 may comprise the inner edge of a circumferential wall 42 extending upwardly from tool element face 44 to provide a greater bearing surface against the hub wall.

As seen in FIG. 11, hub wall 18 is again undercut to provide an arcuate recess 22 to accept a pair of opposed arcuate projections or flanges 46 extending inwardly into the mounting bore 20 from the inner bore surface 40. Wall 18 of hub 10 has a pair of cut-out sections 48 to accommodate the flanges 46, dividing the recess 22 into two diametrically opposed portions, and to allow the flanges 46 to align with and enter the wall recess or groove portions 22 as the tool element 14 is rotated with respect to the hub 10 for mounting purposes.

Figure 7:
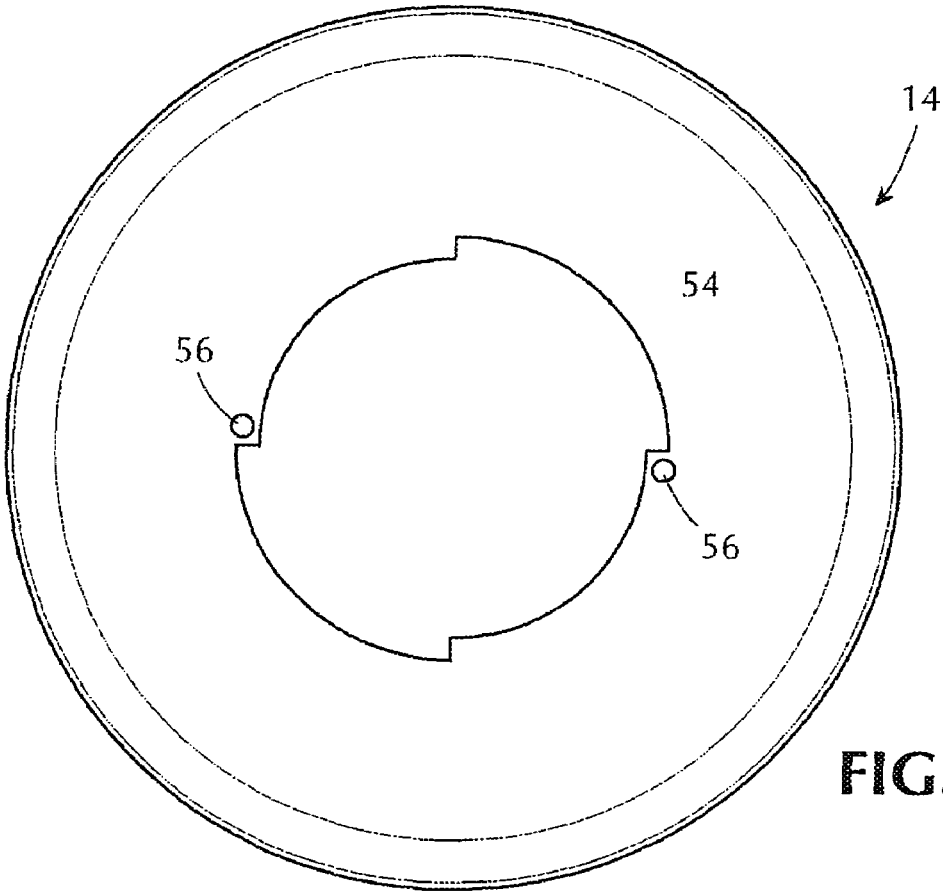
FIG. 7 is a bottom plan view of a tool element of a second embodiment of the mounting system.
Figure 8:
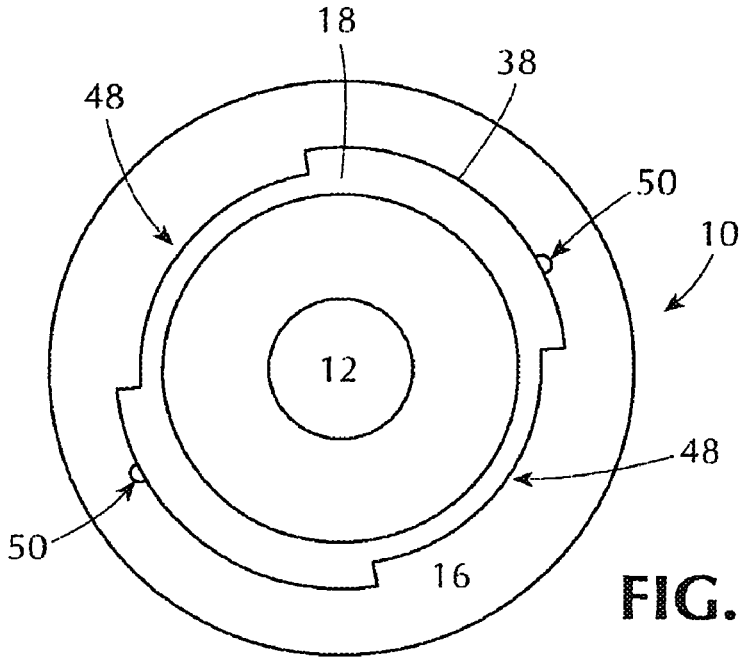
FIG. 8 is a top plan view of a hub thereof.
Figure 9:
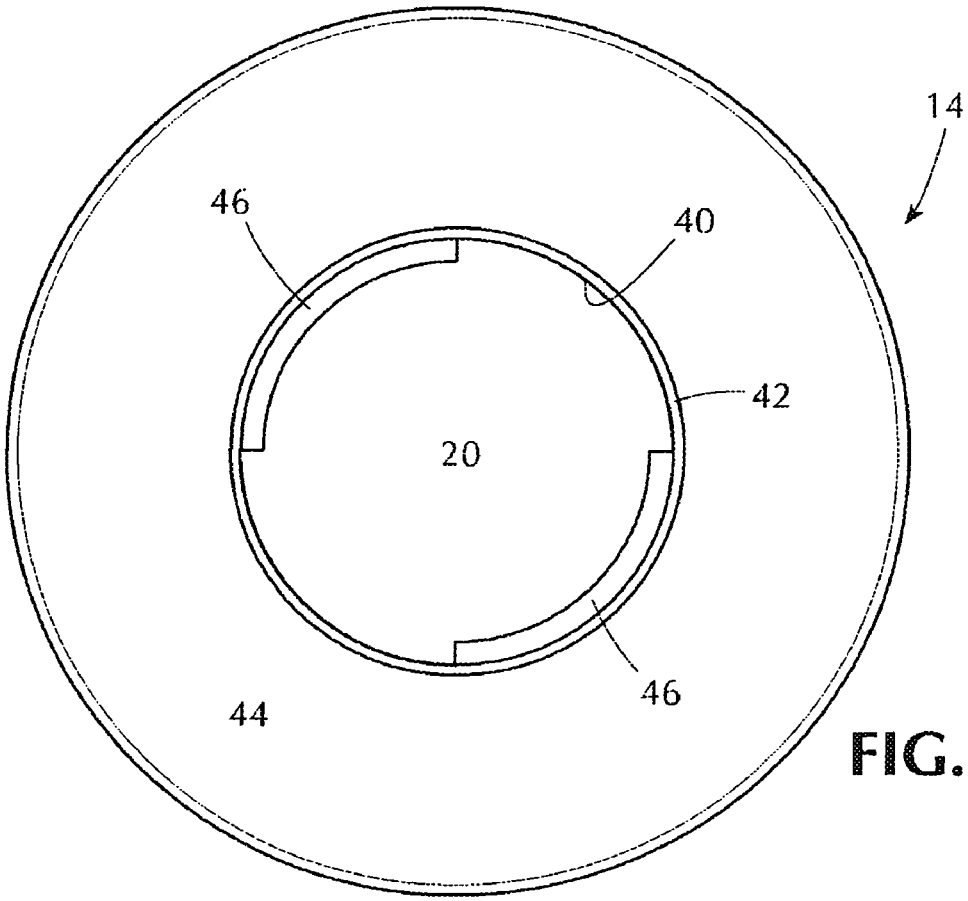
FIG. 9 is a top plan view of the tool element.
Figure 10:
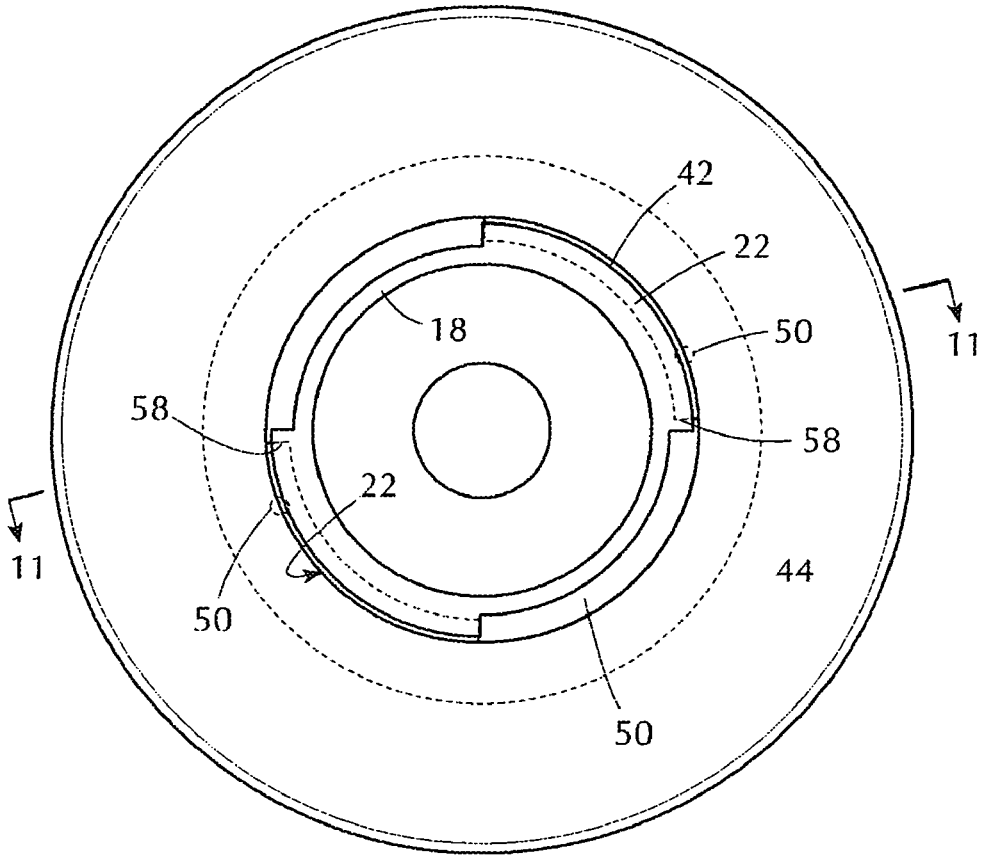
FIG. 10 is a plan view of the second embodiment, depicting the tool element in the mounted and locked position upon the hub.
Figure 11:
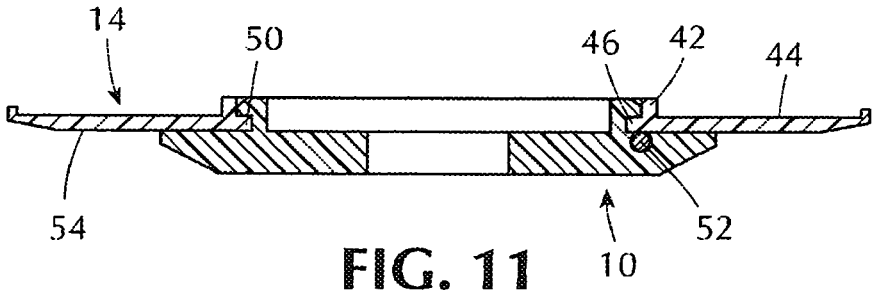
FIG. 11 is a section view taken along line 11-11 in FIG. 10.

To maintain the tool element in the fully-mounted position, the hub and tool element are again provided with complementary frictional lock elements. Projections 50 are located on the face 16 of the hub, and may comprise a pair of small metal balls 52 embedded in the hub and extending slightly above the hub face 16, forming exposed spherical caps. Alternatively, the projections may be merely raised portions of the plastic or similar material from which the hub is formed. As depicted in FIG. 7, the lower face 54 of the tool element is provided with corresponding spherical cap depressions 56, the projecting detent balls 54 engaging with the depressions when the tool element is placed upon the hub and rotated into a locking position. As may be seen in FIG. 10, the recesses 22 in the hub wall 18 are stopped at 58, thus providing a radially-extending end surface against which the forward end of flange 46 abuts when the tool element is fully mounted on the hub. The stops are so located such that abutment with the flanges occur simultaneously with the engagement of the detent projections 50 with the depressions 56. The resiliency of the tool element material permits the tool element to locally flex as the flange initially contacts and passes over the projections 50 until they enter the depressions 56 to retain the tool element in the fully mounted position.

I claim:

1. A mounting system for a rotating tool, comprising:

a hub mountable to a tool drive shaft;

a planar rotating tool element body having a central aperture with a sidewall extending downwardly through the tool element from a first planar face to an opposed second planar face of the tool element body, the tool element being removably mountable by way of the aperture upon the hub, the sidewall having at least one radially-extending flange in the form of a flexible convex arcuate segment portion of the sidewall projecting inwardly between planes defined by the tool element planar faces into the aperture;

the hub having a face abutting the first planar face of the tool element and bearing a circumferentially-extending upwardly extending wall with an outer surface aligned with the tool element sidewall and extending through the tool element central aperture, the wall having an outer circumferential ledge parallel to and spaced from the hub face and overlying the radially-extending flanges of the tool element, a recess being formed between the face, the ledge and a portion of the wall between the face and ledge, the ledge having at least one cut-out to accept the at least one flange and allow the at least one flange to engage the recess, the tool element being rotatable in a mounting direction with respect to the hub to retain the at least one flange of the tool element away from the at least one cut-out within the recess, the recess having at least one inwardly directed depression in the wall portion between the face and ledge complementary to the at least one radially-extending flange accepted by the recess to form with the received flange a complementary lock mechanism to retain the tool element in a releasable fixed orientation upon the hub with a projecting lock element being engaged by the depression when the tool element is rotated in a mounting direction with respect to the hub.

2. The mounting system of claim 1 wherein the flexible arcuate segments have an inner edge defined by a portion of a bore through the tool element.

3. The mounting system of claim 1 wherein the flanges are three in number and are located equidistantly about the hub wall.

4. A mounting system for a rotating tool, comprising:

a hub mountable to a tool drive shaft;

a planar rotating tool element body having a central aperture with a sidewall extending downwardly through the tool element from a first planar face to an opposed second planar face of the tool element body, the tool element being removably mountable by way of the aperture upon the hub, the sidewall having at least one radially-extending flange projecting inwardly between planes defined by the tool element planar faces into the aperture;

the hub having a face abutting the first planar face of the tool element and bearing a circumferentially-extending upwardly extending wall with an outer surface aligned with the tool element sidewall and extending through the tool element central aperture, the wall having an outer circumferential ledge parallel to and spaced from the hub face and overlying the radially-extending flanges of the tool element, a recess being formed between the face, the ledge and a portion of the wall between the face and ledge, the ledge having at least one cut-out to accept the at least one flange and allow the at least one flange to engage the recess, the tool element being rotatable in a mounting direction with respect to the hub to retain the at least one flange of the tool element away from the at least one cut-out within the recess, the recess having at least one inwardly directed depression in the wall portion between the face and ledge complementary to the at least one radially extending flange accepted by the recess to form with the received flange a complementary lock mechanism to retain the tool element in a releasable fixed orientation upon the hub with a projecting lock element being engaged by the depression when the tool element is rotated in the mounting direction with respect to the hub and the circumferentially-extending wall further having a radially outwardly projecting ramp surface portion for a flange adjacent the depression.

5. The mounting system of claim 1, the recess having an end wall extending between the ledge located adjacent one of the at least one inwardly directed depressions.

6. The mounting system of claim 4, wherein the ramp surface terminates at a depression.

* * * * *